United States Patent [19]

Dicke

[11] Patent Number: 4,478,010

[45] Date of Patent: Oct. 23, 1984

[54] IN-LINE SANDER

[75] Inventor: William C. Dicke, Easley, S.C.

[73] Assignee: The Singer Company, Stamford, Conn.

[21] Appl. No.: 555,240

[22] Filed: Nov. 25, 1983

[51] Int. Cl.[3] ..... B24B 23/04

[52] U.S. Cl. ..... 51/170 TL; 51/175

[58] Field of Search ..... 51/170 TL, 170 MT, 170 R, 51/175, 180

[56] References Cited

U.S. PATENT DOCUMENTS

| | | | |
|---|---|---|---|
| 2,455,626 | 12/1948 | Trout | 51/170 TL |
| 2,545,942 | 3/1951 | Crosby et al. . | |
| 2,755,673 | 7/1956 | Dixon | 51/170 TL |
| 2,764,703 | 9/1956 | Anton . | |
| 2,790,276 | 4/1957 | Acopian . | |
| 2,830,411 | 4/1958 | Hartmann . | |
| 2,893,175 | 7/1959 | Bruck . | |
| 2,893,177 | 7/1959 | Bruck . | |
| 3,083,508 | 4/1963 | Fegley et al. . | |
| 3,349,523 | 10/1967 | Hutchins . | |
| 3,540,161 | 11/1970 | Anton et al. . | |
| 4,216,631 | 8/1980 | Ryer | 51/170 MT |

*Primary Examiner*—Roscoe V. Parker

*Attorney, Agent, or Firm*—Edward P. Schmidt; Robert E. Smith; Edward L. Bell

[57] ABSTRACT

An in-line sander for hand held operation and having a housing in which a rotating electric motor drives a drive shaft to rotate on a first axis, with a second axis of the drive shaft canted to the first axis and supporting a bearing thereon. A wobble housing is supported on the bearing to orbit therewith, the wobble housing having an arm extending to a platen support and extensibly and pivotably connected to a portion thereof. This orbiting of the wobble housing influences motion of the platen support in accordance with the angle of the cone described by the second axis of the drive shaft. The platen support is made of a resilient material and carried by the housing on legs extending to a base portion, which legs have a low moment of inertia in the direction of in-line sanding, and a high moment of inertia normal to the direction of in-line sanding, so as to be disposed to motion in the in-line sanding path only. A platen is attached to the platen support by a key and key slot, one on each, which permits assembly when mis-aligned and retains the platen to the platen support when rotated to an aligned position. Resilient paper clamps are provided which cooperate with grooves in the upper surfaces of posts on the platen, to retain sand paper to the platen.

3 Claims, 5 Drawing Figures

IN-LINE SANDER

BACKGROUND OF THE INVENTION

This invention is concerned with a sanding device; more particularly, it is concerned with an in-line, hand held, sanding device.

Generally, in-line sanders are used as finishing sanders, the in-line motion thereof operates better with wood grain and more closely simulates hand sanding then the orbital motion of an orbital sander. Thus, the inline sander is used in place of hand sanding for large flat areas. There are examples in the prior art of dual motion sanders having the capability, selectively, to operate as an orbital sander, or as an in-line sander. These devices are generally bulky and heavy. There are, however, many devices disclosed in the prior art which are dedicated to in-line motion and to use as a finishing sander.

One such dedicated device is disclosed in the U.S. Pat. No. 2,830,411 of Hartman, which discloses an inline sanding device actuated by a rotary electric motor axially oriented normally to the sanding surfaces and driving a jack shaft through speed reduction gears, with the jack shaft supporting an eccentric for urging of the sanding surface in in-line reciprocation. Such an orientation of the electric motor created a bulky device; but the rotary electric motor provided a relatively quietly operating device.

The U.S. Pat. No. 2,545,942 of Crosby et al. discloses an orbital sanding device in which actuation is by a rotary electric motor axially oriented parallel to the sanding surface. The sanding surface is driven in an orbital path by eccentrics on shafts on either end of the motor shaft and at right angles thereto which are carefully counterweighted and connected to the motor shaft by bevel gears.

The U.S. Pat. Nos. 3,083,508; 2,790,276 of Fegley et al. and Acopian, respectively, disclose more compact linear sanding devices which are readily grasped and manipulated by one hand, but which are driven in linear reciprocation by vibratory electromagnets, and which can, therefore be, very noisy and distracting. A further problem encountered with the use of vibratory electromagnets is that any attempt to increase the speed of wood removal by bearing down on these devices will also increase the loading on the electromagnet and slow down operation thereof.

It is apparent that, ideally, what is required is a rotary motor actuated linear sander in a compact and economical construction which can be readily grasped and manipulated by one hand. In this fashion, the quiet operating characteristics of the electric motor and the power and durability inherent in such a device, might be accommodated in a package which is readily grasped by one hand to enable a relatively effortless sanding operation closely akin to hand sanding.

SUMMARY OF THE INVENTION

The above requirements are attained in the invention in which a rotary electric motor is mounted in a support half of a clam shell housing with the rotating axis thereof extending parallel to the in-line motion of a sanding platen associated with the housing. A wobble drive shaft extends parallel to the motor shaft, and is urged into rotary motion by a gear reduction from the motor shaft. An end of a wobble drive shaft is canted at an angle to the main axis of the wobble drive shaft and supports a ball bearing thereon. A wobble bearing housing encircles the ball bearing and an arm thereof ends in a pivot ball captured in a well on a platen support. Thus, as the motor shaft rotates, the wobble drive shaft will rotate resulting in an orbit of the wobble bearing housing about the axis of the drive shaft but with the housing axis describing a cone so as to influence in-line motion of the platen support. The platen support, which is preferably fashioned from a synthetic resin material, is molded with a flat base section that supports on the inner side the well which receives the pivot ball of the wobble bearing housing to provide an extensible and rotatable connection thereto. Also extending upwardly from the top surface of the face of the platen support are two pair of legs, one pair each on either end of the platen support. These legs are arranged to provide a minimum thickness and moment of inertia in the direction of the in-line sander motion so as to provide the least resistance to motion in that direction, and a maximum dimension and moment of inertia transverse to the in-line motion so as to provide a greater rigidity to motion in that direction. Each pair of legs on either end of the platen support extend a distance from the base of the platen support to allow these legs to operate as aslender columns and then the pair of legs on either end are joined together by a bar of square cross section having a diagonal thereof as an extension to the legs, which bar may be received in corresponding cavities molded as part of the clam shell housing which is preferably fabricated from a synthetic resin material also. A keying system is provided for firmly attaching the platen support to a platen, which platen may recieve a sheet of sand paper on the bottom surface thereof to be retained by wire paper clamps which deflect over grooved tracks in posts carried on the platen.

BRIEF DESCRIPTION OF THE DRAWINGS

The invention is illustrated by way of example in the accompanying drawings wherein:

Referring now to FIG. 1, there is shown a side elevation of an in-line sander 10 in which a sanding platen 12 carried thereby reciprocates laterally as viewed in FIG. 1. The in-line sander 10 may be connected by means of electrical leads 14, only a portion of which are shown, to a source of electric power so as to influence endwise reciprocation of the platen 12 when initiated by actuation of the switch actuator 16. The in-line sander 10 may include a housing 18 of clam shell construction in which a support half 20 (see FIG. 2) supports the various components therein and a cover half 22 might be attached thereto by screws 23.

Referring to FIG. 2, the in line sander 10 is shown with the cover housing 22 broken away therefrom in order to show the internal details of construction. Thus, it is shown that the support housing 20, which is preferably molded of a synthetic resin material, is fashioned with ribs to support therein a motor 25, including a stator 24, and rotor 26 having a shaft 27 carried in bearings 28, 30, also supported by ribs formed as part of the cover housing. The shaft 27 also supports thereon a fan 32 for directing cooling air from vents (not shown) supplied in the cover housing 22 and support housing 20 so as to provide for motor cooling. Also supported on the shaft 27 of the rotor 26 is commutator 34 which is engaged by brushes 36 supported in brush tubes 37 themselves carried by ribs molded as part of the cover housing 22 and support housing 20. Switch actuator 16 is seen to extend to switch 17 for selective actuation thereof.

Figure 1:
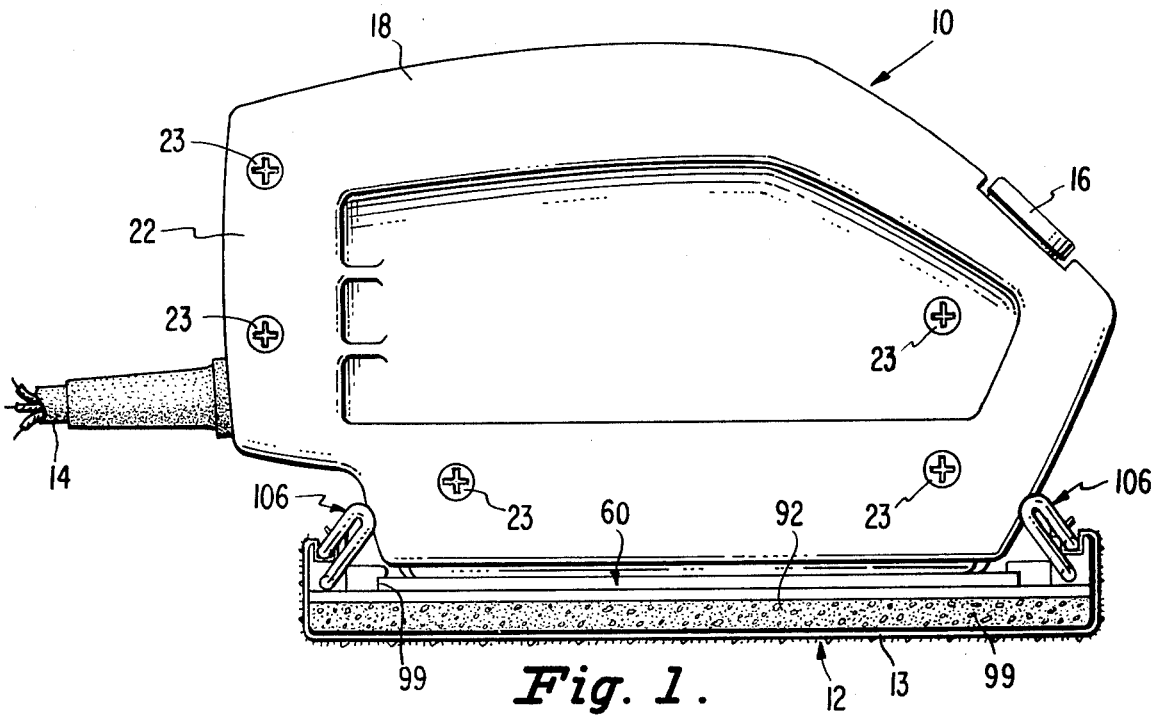
FIG. 1 a side elevation of the in line sander of the invention.

Beyond the ball bearing 30, the rotor shaft 27 supports thereon pinion 38. Pinion 38 is in mesh with gear 40 carried by a wobble drive shaft 42, itself, supported on bearings 44, 46 carried on ribs of the support housing 20 and cover housing 22. Wobble drive shaft 42 is formed with an end 43 thereof having its axis at an angle or canted to the main portion of the drive shaft 42. Thus, as the drive shaft 42 is rotated, the axis of the end 43 thereof would describe the surface of a cone.

A wobble bearing 50 implemented by a ball bearing is supported on the end 43 of the drive shaft 42. A wobble bearing housing 52 shown partly in section, is attached to the outer periphery of the wobble bearing 50, typically by retaining ring 53. The wobble bearing housing 52 is formed with an arm 54 extending therefrom, which arm terminates in a pivot ball 56.

Figure 2:
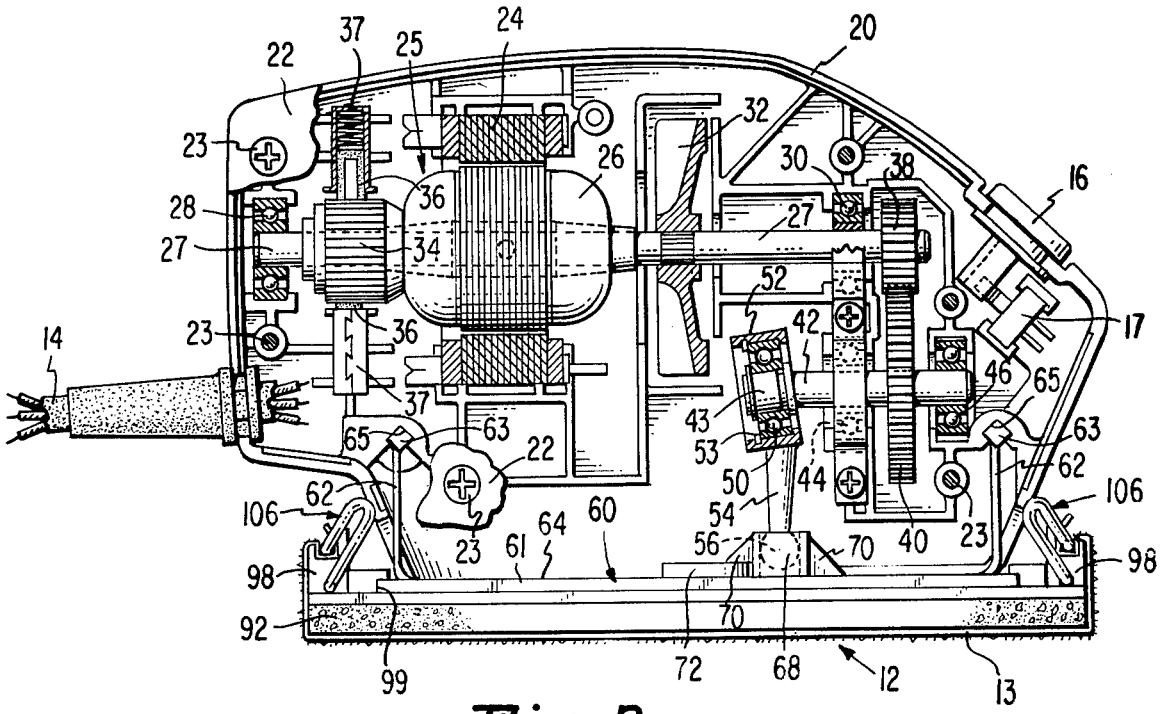
FIG. 2 is a view similar to FIG. 1 with a portion of a clam shell cover broken away and partially in section to show inner details thereof.
Figure 3:
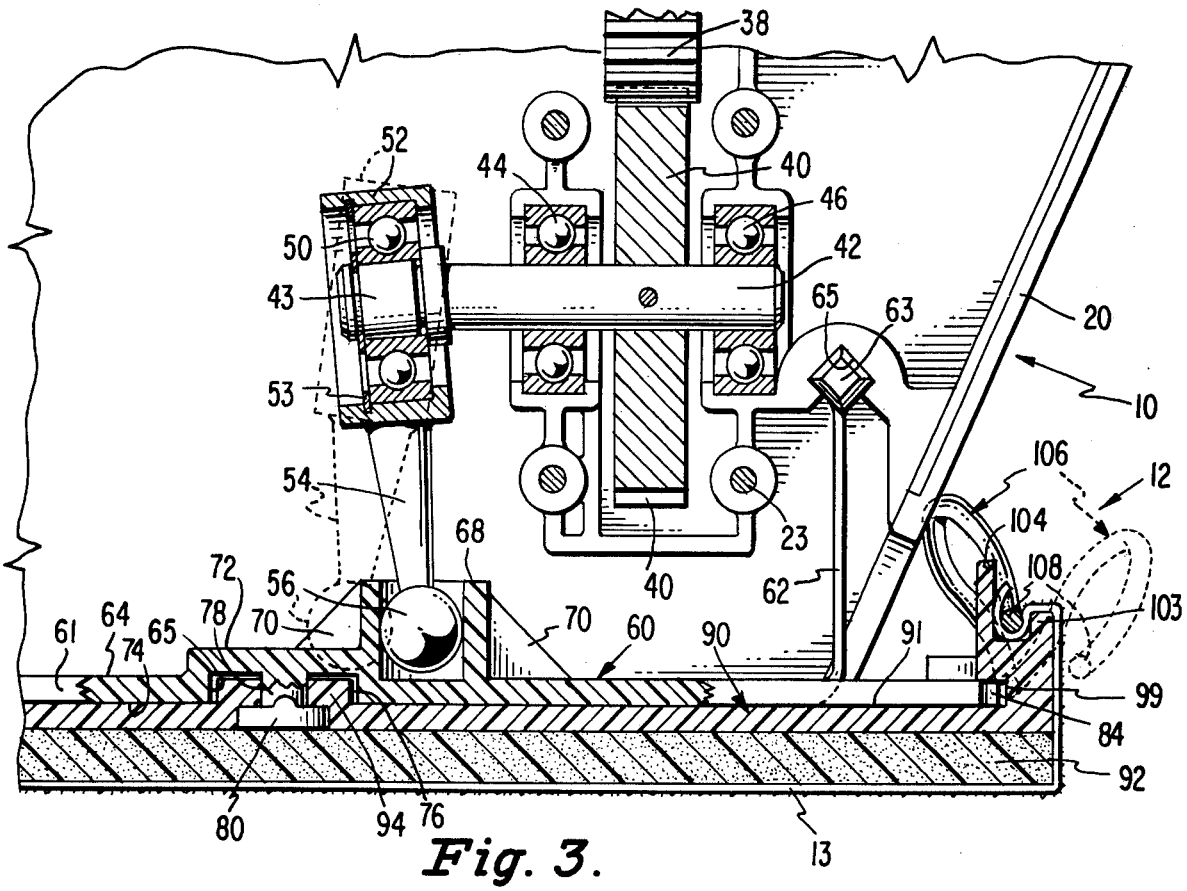
FIG. 3 is an enlarged detailed view of the drive for the platen support.
Figure 4:
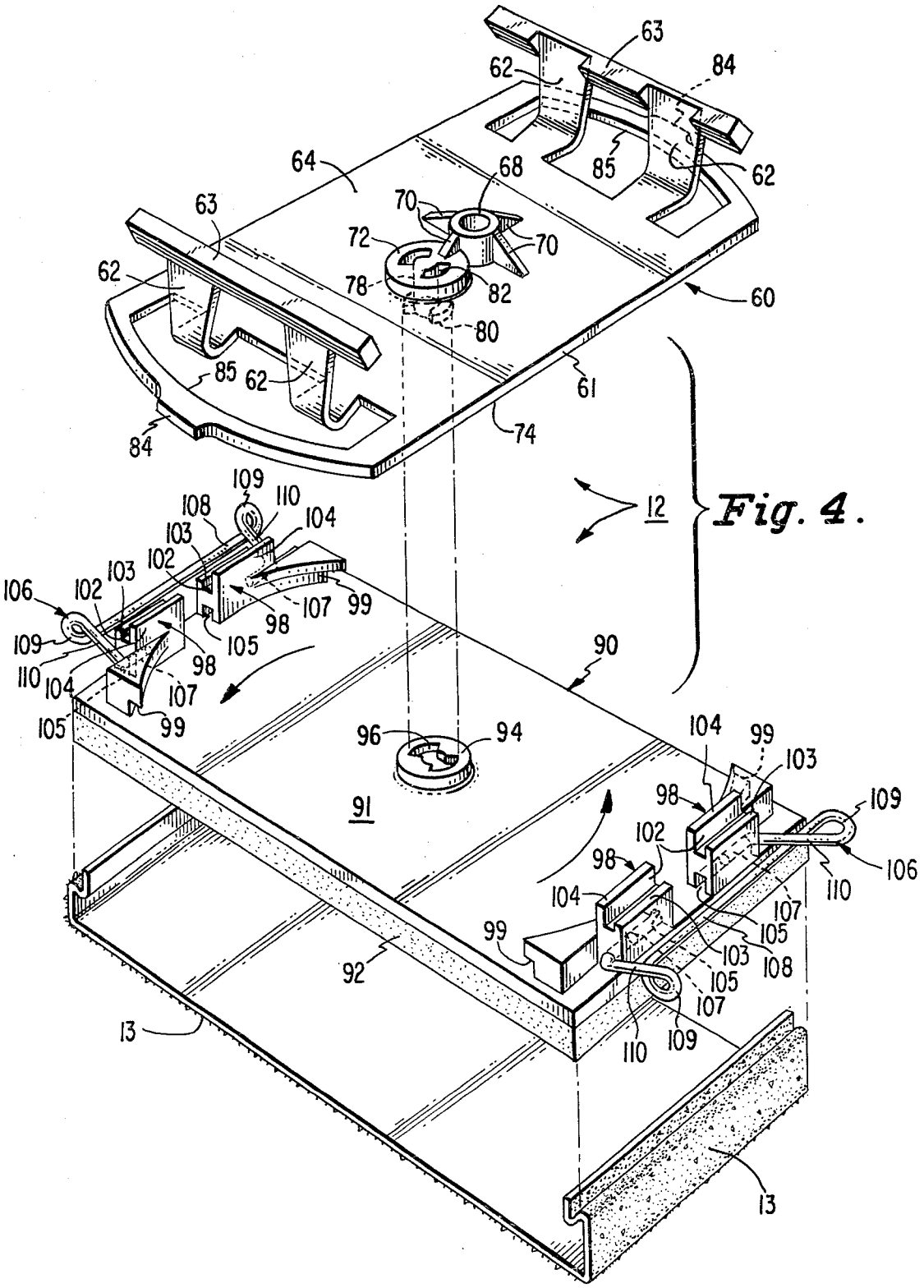
FIG. 4 is a disassembled perspective view of the platen support and platen to show the manner of disassembly and assembly thereof; and, FIG. 5 is a detached perspective view of key and key slot of the platen support and platen to provide a greater understanding of the assembly thereof.

Also visible in FIG. 2, is a platen support 60 which may also be formed of a molded synthetic resin material or other resilient material. The platen support 60, also visible in FIGS. 3 and 4, is fashioned with a base portion 61, from which base a pair of legs 62 extend upwardly from either end approximately normally thereto. The upper end of each pair of legs 62 are joined by a bar 63 of square cross section having a diagonal thereof as an extension to the legs. The bars 63 are received in corresponding cavities 65 formed as part of the support housing 20 and cover housing 22.

Extending upwardly from the base portion 61 of the platen support 60, is a well 68 of circular hollow interior. Ribs 70 extend from the upper edge of the well 68 to the base portion 61 for the purpose of increasing the rigidity of the well. The hollow internal diameter of the well 68 is of a dimension to slidably receive the pivot ball 56 on the end of the arm 54 of the wobble bearing housing 52 (see FIG. 3). Thus, it can be appreciated, that as the drive shaft 42 is urged into rotation by the actuation of the motor 25, the attachment of the wobble bearing 50 to the canted end 43 of the drive shaft will cause the wobble bearing to orbit around the axis of the drive shaft 42 so that the pivot ball 56 at the extremity of the arm 54 attached to the wobble bearing housing 52, will be constrained by the well 68 in platen support 60 to which it is attached to move in a back and forth path, with any lateral oscillations of the housing 52 being accommodated by a vertical motion within the well 68. Linearity of motion of the platen support 60 is as a result of the limberness or flexibility of the legs 62 in the direction of the length of the base 61, or longitudinally, implemented by minimum thickness; and of the rigidity of each spaced apart pair of legs on either end of the base to motion in a direction normal to the length of the base, implemented by width of each leg and wide spearation therebetween. In other words, the moment of inertia of the legs 62 is extremely low in the long dimemsion of the base 61, and the moment of inertia of a pair of legs 62 is extremely high in a direction transverse to the long dimension of the base. The moment of inertia in the transverse direction is enhanced by the maximum separation possible between legs in each pair of legs on the base 61. The result is that essentially no transverse motion will take place, while longitudinal motion is quite readily accommodated. The legs 62 may be fashioned of uniform thickness, but with a greater width adjacent bar 63 and tapering to the base 61 to improve its resistance to hand pressure on the housing pressing the platen 12 and sand paper 13 carried thereby against a work material such as an article of furniture, providing improved capability as a column without affecting its flexibility in the longitudinal direction or its lateral rigidity. In place of a pair of legs 62 on each end of the platen support 60, it is apparent that a single leg of much greater width but the same thickness could be used having much the same characteristics.

Immediately adjacent the well 68 on the platen support 60 there is located a platform 72 which extends above the top 64 of the base 61. Visible in FIGS. 3, 4 and 5, the platform 72 on the top 64 of the base 61 is fashioned with a circular counterbore 76 extending from the bottom 74 of the base (see FIG. 3) coaxially with the circular platform 72 and having an inner flat face at about the level of the top 64 of the base. The circular counterbore 76 is formed with a supporting pin 78 extending in depth to approximately the bottom surface 74 of the base portion 61 and terminating therein in a bow tie shaped key 80. Apertures 82 may be molded as part of the circular platform 72 in order to provide core access for molding of the bow tie key 80. Additionally to the above, the base 61 of the platen support 60 is formed with tab extensions 84 to the base beyond the legs 62 thereof, for a purpose which will be explained below.

Figure 5:
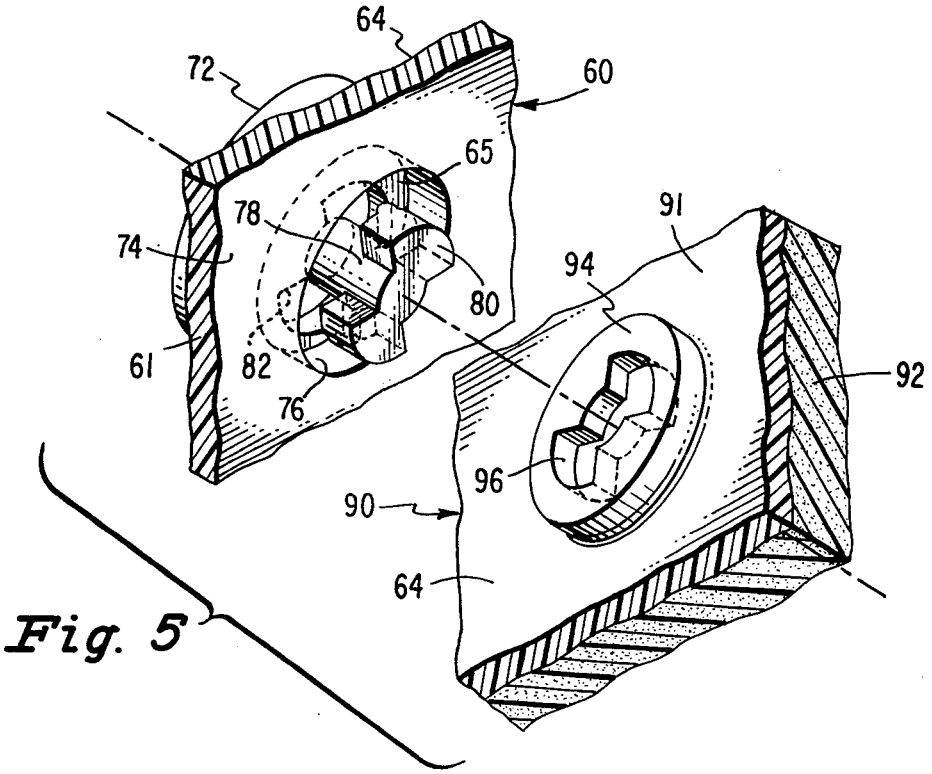

Also referring to FIGS. 3, 4 and 5, there is visible a platen 90 which is positioned immediately adjacent the platen support 60. The platen 90 includes a rubber pad 62 which is affixed to the bottom thereof to provide a resilient surface for the sand paper 13 which is positioned abutting this platen. The top surface 91 of the platen 90 and the bottom 74 of base 61 of platen support 60 are mating surfaces which are contiguous when these parts are assembled. The top surface 91 is formed with a raised circular land 94 of a diameter to be accommodated in the circular counterbore 76 of the platen support 60. The raised circular land 94 is fashioned with a key slot 96 to accommodate the bow tie key 80 of the platen support 60, with the key slot extending for a thickness something less than the length of the pin 78 and the raised circular land being counterbored beyond that point to a diameter to freely accommodate rotation of the bow tie key 80. As shown in FIG. 4, the bow tie key 80 extends transversely across the platen support 60, whereas the key slot 96 in the platen 90 extends in the lengthwise direction of the platen. Accordingly, the bow tie key 80 may be fitted into the key slot 96 when the platen support 60 and platen 90 have their maximum lengthwise direction at 90° to one another; and with the key extending through the key slot, the platen support may be rotated so that the bow tie key may not be withdrawn through the key slot 96.

The platen 90 is further formed with a pair of posts 98 on each end thereof, which posts are grooved 99 adjacent the top surface 91 of the platen on a radius swung from the center of the raised circular land 94. The grooves 99 of the posts 98 are of a sufficient height to accommodate the tab extensions 84 of the base 61 of the platen surface 60, but, ideally, the length across the tab extensions 84 of the platen support 60 exceeds the dimensions between the grooves 99 of the posts 98 on either end of the platen 90 sufficiently to cause a slight interference when the raised circular land 94 of the platen is inserted into the counterbore 76 of the platen support and the platen is rotated to bring the tab extensions into the grooves. The posts 98 on either end of the platen 90 are spaced apart a sufficient amount to accommodate the width of the tab extensions 84 of the platen support 60, so that as the platen support is rotated to place the tab extensions between the posts, the platen support will snap into a position aligned with the platen in a detent action. A slot 85 extends laterally across the base 61 behind each tab extension 84 to permit deflection of each tab extension are mounted sufficient to allow the tab extensions to enter the grooves 99. This deflection is enhanced if the platen support 60 is fashioned from a synthetic resin material such as nylon.

The posts 98 are further fashioned with vertical grooves 102 extending across the posts from the top thereof. The outer walls 103 defining the vertical grooves 102 are shorter than the inner walls 104 thereof. The pair of posts 98 on either end of the platen 90 are formed with apertures 105 extending transversely of the platen parallel to the ends thereof. Thus, apertures 105 on each end of the platen 90 are axially aligned, and are spaced adjacent the end of the platen and parallel thereto. A formed wire 106 is arranged with ends 107 extending into the apertures 105 on the outside of posts 98 on each end of platen 90. The formed wire 106 is then bent 90° to pivot adjacent the posts 98 beyond the outer wall 103 thereof. A central straight portion 108 of the formed wire 106 is spaced from the ends 107, and parallel thereto, at a distance therefrom which would bring it into engagement with the outer wall 103 adjacent the top thereof on pivotal motion of the formed wire. A resilient connection 109 between the central straight portion 108 and radial portions 110, allows the central straight portion to deflect outwardly of the ends 107 and over the top of the outer wall 103 and into vertical groove 102. As shown in the drawings, the resilient connection 109 is implemented by forming the radial portions 110 in 270° of a circle large enough for a given wire diameter to provide the desired resiliency, terminating in the central straight portion 108. Thus, the paper clamp formed wire 106 may be rotated outwardly of the post 98 atop the sand paper 13, from which position it may be rotated over the outer wall 103 of the post with the central straight portion 108 of the formed wire 106 deflecting the end of sand paper 13 into the vertical groove 102 in the pair of posts 98 on one end of the platen 90. The vertical groove 102 is of such a width to accommodate the diameter of wire 106 used, and thickness of sand paper 13, as is shown in FIG. 3. The paper clamp thus implemented deflects the sand paper 13 into the vertical grooves 102, effecting a tautening of the sand paper during the process of deflecting over the outer wall 103 and obtaining a snap of the central straight portion 108 thereof into the groove which retains the sand paper until released by a deliberate operator outward manipulation of the resilient connections 109 to remove the central straight portion 108 from the groove 102.

By way of example, operation of the motor 25 at a no load speed of 23,000 RPM might reciprocate the platen 90 and the sand paper 13 carried thereby at 8000 strokes per minute, with the proper speed reduction gearing. For this finishing sander, in which the sanding operation takes place in the same direction as the wood grain, a stroke might entail a $\frac{1}{8}''$ out and return motion, for example.

The foregoing detailed description is given for clearness of understanding only, and no unnecessary limitations should be understood therefrom, for some modifications will be obvious to those skilled in the art.

I claim:

1. An in-line sander for moving sand paper in a linear path, said sander being adapted to be held in the palm of a hand for urging a work surface, said sander comprising:

a housing;

a rotating electric motor supported by said housing, said motor having a output shaft parallel to a plane including said linear path;

a drive shaft rotatably supported by said housing substantially parallel to said linear path;

a gear transmission connecting said motor output shaft and said drive shaft for actuating said drive shaft;

a platen;

means on said platen for retaining a strip of sand paper affixed thereto;

means supported by said housing and constrained to move in a linear path for supporting said platen with said sand paper in a position urging against said work supporting surface, said supporting means including a platen support fashioned from a resilient material and including a base portion for attachment to said platen, a pair of legs extending from said base portion to a free end contiguous said housing for attachment thereto, said legs having a flexibility implemented by a low moment of inertia in the direction of said linear path, said legs further having a rigidity implemented by a high moment of inertia in a direction transverse to said linear path; and, means carried by said drive shaft and connected with said supporting means for influencing motion of said support means in said linear path.

2. An in-line sander as claimed in claim 1 wherein said influencing means further comprises an end of said drive shaft having an axis canted with respect to that portion rotatably supported by said housing, a bearing supported on said end coaxial therewith, a wobble housing supported on said bearing, said wobble housing including an arm extending to said platen support and extensibly and pivotably connected to a portion thereof, whereby rotation of said drive shaft causes said axis to describe a cone, with said housing moving with said bearing to have said arm shift said platen support in said linear path in accordance with the angle of said cone described by said axis.

3. An in-line sander as claimed in claim 2 wherein said platen and platen support further comprise mating surfaces having, one on each, a key extending from a supporting pin itself extending from one of said mating surfaces and a key slot through which said key may extend to beyond said slot when said platen and platen support mating surfaces are brought together at an angle from a final supporting position, said platen further comprising posts extending from its mating surface, said posts being undercut adjacent said mating surface to receive said platen support when said platen is rotated to said final supporting position, whereby said platen is retained to said platen support by said undercuts and by said key rotated away from said key slot.

* * * * *